United States Patent [19]

Zummer et al.

[11] Patent Number: 4,987,637

[45] Date of Patent: Jan. 29, 1991

[54] CANISTER VACUUM CLEANER AND METHOD OF MANUFACTURE

[75] Inventors: Linda A. Zummer, St. Joseph; Donald E. Janke, Benton Township, Berrien County, both of Mich.; James R. Giordano, Danville, Ky.

[73] Assignee: Whirlpool Corporation, Benton Harbor, Mich.

[21] Appl. No.: 920,959

[22] Filed: Oct. 20, 1986

[51] Int. Cl.[5] ..... A47L 5/12; A47L 9/28

[52] U.S. Cl. ..... 15/328; 15/377

[58] Field of Search ..... 15/377, 319, 328

[56] References Cited

U.S. PATENT DOCUMENTS

| | | | |
|---|---|---|---|
| 2,072,689 | 3/1937 | Smellie | 15/377 X |
| 3,579,706 | 5/1971 | Hetland | 15/377 X |
| 3,588,943 | 6/1971 | Hetland | 15/377 X |
| 3,936,904 | 2/1976 | Bashark | 15/319 X |
| 4,357,729 | 11/1982 | Vander Molen et al. | 15/377 X |

*Primary Examiner*—Philip R. Coe
*Assistant Examiner*—Scott J. Haugland
*Attorney, Agent, or Firm*—Mason, Kolehmainen, Rathburn & Wyss

[57] ABSTRACT

A canister vacuum cleaner includes a floor cleaning unit having a rotatable brush driven by a brush motor and a remotely disposed canister having a vacuum or suction motor for providing suction to perform cleaning operations. The floor cleaning unit is mechanically and pneumatically interconnected with the canister through a rigid wand and a wand handle and hose assembly. The wand handle and hose assembly includes a wand handle, disposed between the rigid wand and a flexible hose, with a three-position electrical control switch mounted thereon. The control switch enables the deenergization of both the brush motor and the vacuum motor in a first position, enables the energization of the vacuum motor only in a second position and enables the energization of both the vacuum motor and the brush motor in a third position. An electrical control system includes an electrical control circuit for electrically interconnecting the control switch, the brush motor and the vacuum motor with a source of alternating current power by means of three electrical conductors internally disposed within and along the length of the flexible hose and two electrical conductors externally disposed along the length of the wand. The control system further includes a motor relay physically disposed in the canister and electrically interconnected in the control circuit such that the electrical current required to operate the vacuum motor does not pass through the wand handle and hose assembly. The electrical control circuit is configured to facilitate the manufacture of canister vacuum cleaners and to enable the wand handle and hose assembly to be used interchangeably with different models of canister vacuum cleaners.

6 Claims, 3 Drawing Sheets

CANISTER VACUUM CLEANER AND METHOD OF MANUFACTURE

BACKGROUND OF THE INVENTION

A. Field of the Invention

The present invention generally relates to canister vacuum cleaners and, more particularly, to a canister vacuum cleaner with an electrical control system including a three-position control switch mounted on the wand handle of a wand handle and hose assembly disposed between a floor cleaning unit and the canister of the vacuum cleaner.

B. Description of the Prior Art

Electrical control systems for controlling the energization of a plurality of electrical motors, particularly in vacuum cleaners, are old and well known in the prior art as exemplified by U.S. Pat. Nos. 2,072,689; 2,354,787; 3,070,732; 3,413,779; 3,458,892; 3,525,876; 3,579,706; 3,588,943; 3,669,145; 4,021,879; 4,070,586; and 4,357,729. All of the above patents, except the '787 patent and the '732 patent, relate to electrical control systems for vacuum or suction cleaning systems. Furthermore, the '876 patent, the '706 patent, the '943 patent, the '879 patent and the '729 patent all relate to vacuum cleaning systems in which a rotatable brush is driven by a brush motor in a floor cleaning unit remotely located from and interconnected through a wand and a wand handle and hose assembly to a suction or vacuum motor, typically located in a canister. As is conventional, the wand handle and hose assembly may have incorporated therein electrical conductors for energizing the brush motor in the floor cleaning unit without the need for external conductors extending between the canister and the floor cleaning unit. In many of the prior art patents, a control switch for controlling the energization of the brush motor or the vacuum motor is located on the wand handle disposed between the wand and the hose; and a two-wire system or a three-wire system or a combination of both is used to electrically interconnect the control switch and the brush motor and the vacuum motor.

While the electrical control systems of the above prior art patents may be suitable for their intended purposes, there is a need in the vacuum cleaner art for constant improvements in such control systems in order to facilitate the manufacture of vacuum cleaners, to reduce the number of parts required to be kept in stock for the manufacture of vacuum cleaners and to prevent the possibility of damage to certain models of vacuum cleaners displayed on a showroom floor when a wand handle and hose assembly associated with one vacuum cleaner model is inadvertently or intentionally used in connection with a different vacuum cleaner model.

SUMMARY OF THE INVENTION

An object of the present invention is to provide a new and improved canister vacuum cleaner.

Another object of the present invention is to provide a new and improved method or process of manufacturing canister vacuum cleaners.

Another object of the present invention is to provide a canister vacuum cleaner with a new and improved electrical control system for electrically interconnecting a brush motor in a floor cleaning unit through a wand and a wand handle and hose assembly with a remotely located vacuum motor in a canister of the vacuum cleaner.

Another object of the present invention is to provide a canister vacuum cleaner having a new and improved electrical control system configured to facilitate the manufacture of vacuum cleaners, to reduce the requirement for the number of parts to be stocked during the manufacture of vacuum cleaners and to enable a single wand handle and hose assembly to be utilized interchangeably with various different models of vacuum cleaners.

Briefly, the present invention constitutes a new and improved canister vacuum cleaner energized by conventional, 110–120 volts alternating current power under the control of a new and improved electrical control system. The vacuum cleaner includes a rotatable brush powered by a brush motor located in a floor cleaning unit remotely disposed from a canister in which a vacuum or suction motor for providing suction is located. The floor cleaning unit is mechanically and pneumatically interconnected to the canister through a rigid wand and a wand handle and hose assembly. The wand handle and hose assembly includes a wand handle disposed between the rigid wand and a flexible hose. A three-position control switch is located on the wand handle for enabling the deenergization of both the brush motor and the vacuum motor in a first position, for enabling the energization of the vacuum motor only in a second position and for enabling the energization of both the vacuum motor and the brush motor in a third position.

The electrical control system includes the brush motor, the vacuum motor, the three-position control switch and an electrical control circuit for electrically interconnecting the control switch, the brush motor and the vacuum motor with the source of alternating current power. The electrical control system includes three electrical conductors internally disposed within and along the length of the flexible hose and two electrical conductors in a power cable externally disposed along the length of and secured to the rigid wand. The electrical control circuit is configured to enable the wand handle and hose assembly to be used interchangeably with different models of canister vacuum cleaners so as to facilitate the display of various models of vacuum cleaners on a showroom floor and to reduce the possibility of damage resulting from the inadvertent or intentional use of a wand handle and hose assembly associated with one vacuum cleaner model in connection with the operation of a different vacuum cleaner model. In addition, the improved configuration of the electrical control circuit may facilitate the manufacture of vacuum cleaners by reducing the number of parts required to be stocked and by reducing the number of wires interconnected at a particular junction or terminal in the vacuum cleaners.

BRIEF DESCRIPTION OF THE DRAWING

The above and other objects, advantages and novel features of the present invention will become apparent from the following detailed description of the preferred embodiment of the present invention illustrated in the accompanying drawing wherein.

DESCRIPTION OF THE PREFERRED EMBODIMENT

Figure 2:
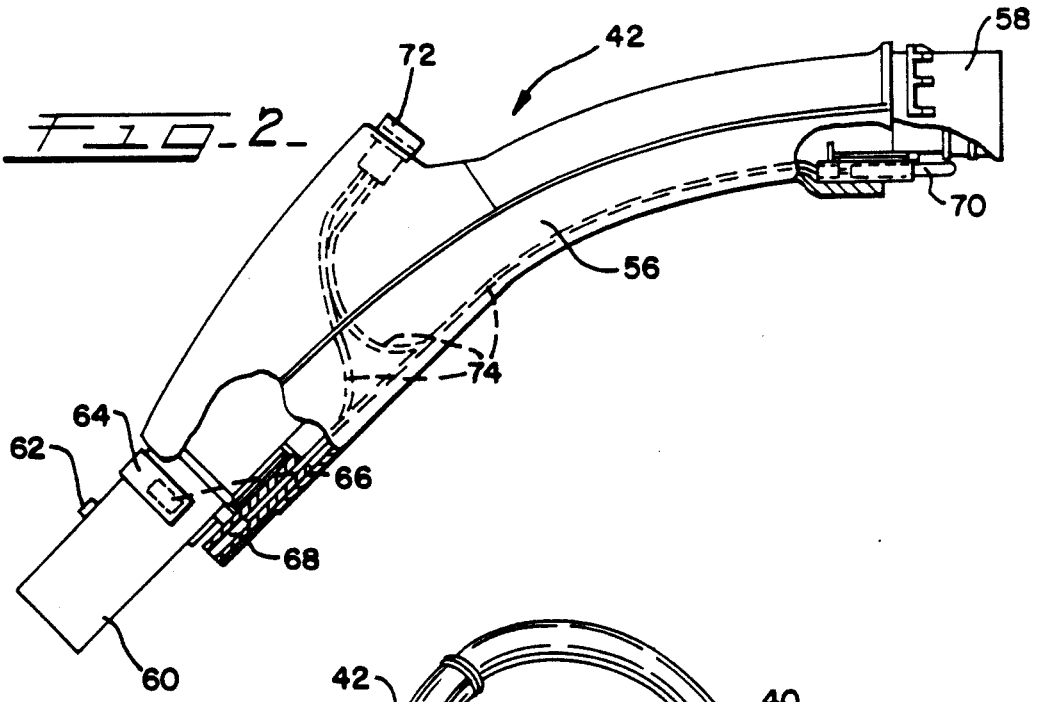
FIG. 2 is an enlarged elevational view of a wand handle of the device of FIG. 1.
Figure 1:
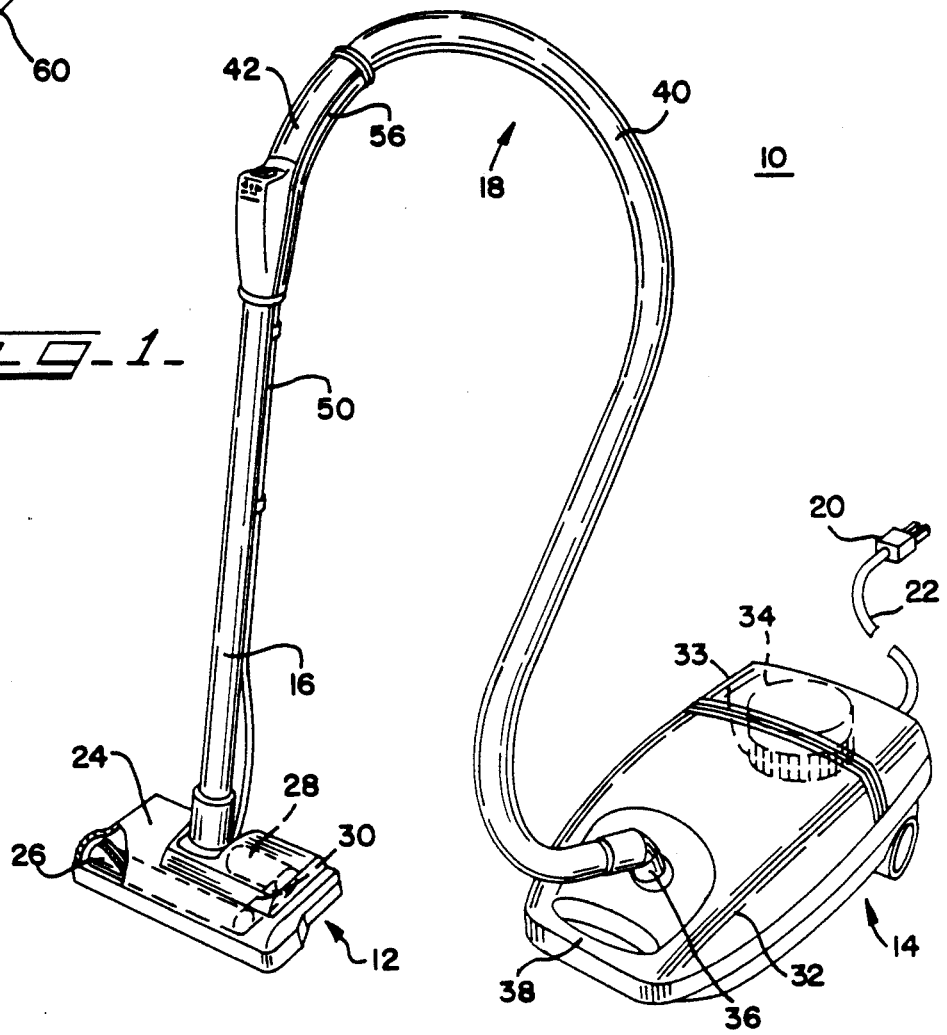
FIG. 1 depicts a canister vacuum cleaner and components of an electrical control system constructed in accordance with the principles of the present invention.
Figure 3:
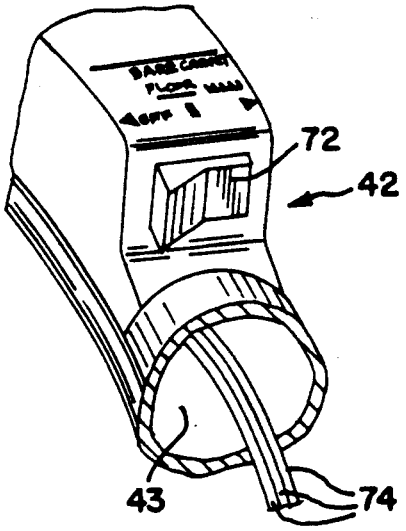
FIG. 3 is a fragmentary, perspective view of a three-position control switch mounted on the wand handle of FIG. 2.

Referring to the drawing and initially to FIGS. 1 through 4, there is illustrated a new and improved canister vacuum cleaner 10 having a new and improved electrical control system 11 (FIG. 4) constructed in accordance with the principles of the present invention. The vacuum cleaner 10 includes a floor cleaning unit 12 (FIG. 1) and a remotely disposed canister 14 mechanically and pneumatically interconnected by a conventional rigid wand 16 and a wand handle and hose assembly 18. The vacuum cleaner 10 is powered by conventional, 110–120 volts alternating current power through an electrical plug 20 mechanically and electrically secured to a conventional, retractable, electrical power cord 22.

The floor cleaning unit 12 includes a housing 24 in which are disposed a rotatable brush 26 and an electrical, alternating current brush motor 28 for rotating the brush 26 through a conventional belt drive assembly 30. The canister 14 includes a housing 32 within which are disposed a conventional dirt collecting bag (not illustrated) and a suction or vacuum fan 33 and a conventional, electrical, alternating current vacuum motor 34 for rotating the fan 33. The canister 14 also includes a suction inlet 36 connected to the wand handle and hose assembly 18 and an integrally formed, canister handle 38 for enabling the canister 14 to be carried by an operator of the vacuum cleaner 10.

Figure 4:
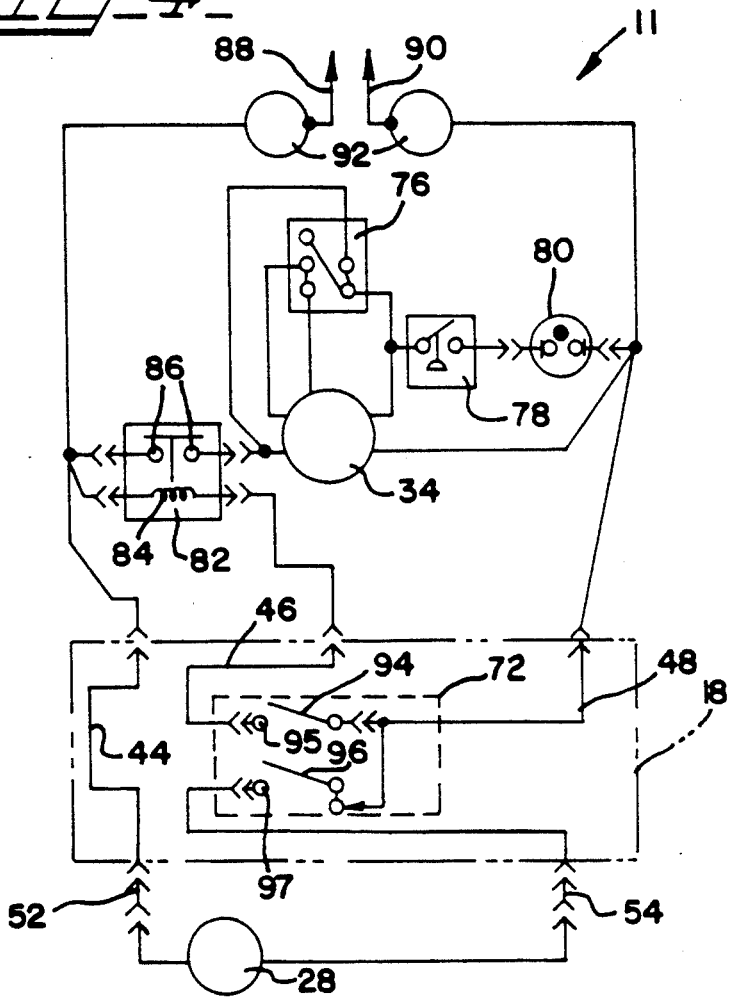
FIG. 4 is a schematic of the preferred embodiment of the electrical control system of the device of FIG. 1.

Suction created by the fan 33, when driven by the vacuum motor 34, is delivered to the remotely located floor cleaning unit 12 through the wand handle and hose assembly 18 and the rigid wand 16. The wand handle and hose assembly 18 includes a conventional flexible hose 40 and a rigid wand handle 42. The wand handle 42 is generally tubular in shape and includes an elongated, interiorly disposed tubular bore 43 (FIG. 3) for pneumatically interconnecting the vacuum or suction fan 33 in the canister 14 with the floor cleaning unit 12 through the wand 16 and the hose 40. The flexible hose 40 includes a plurality of three electrical conductors 44, 46 and 48 (FIG. 4) internally disposed within and along the length of the hose 40. The three electrical conductors 44, 46 and 48 have electrical contacts at their respective opposite ends that electrically interconnect in a conventional manner with mating electrical contacts (not illustrated) associated with the canister 14 and associated with the wand handle 42. The wand 16 includes an externally disposed power cord 50 that is secured in a conventional manner to and extends along the length of the wand 16. The power cord 50 includes a pair of electrical conductors 52 and 54 (FIG. 4). The ends of the electrical conductors 52 and 54 have electrical contacts configured to interconnect in a conventional manner with mating electrical contacts (not illustrated) associated with the floor cleaning unit 12 and with mating electrical contacts associated with the wand handle 42.

The wand handle 42 (FIG. 2) is a rigid composite structure including a plastic tubular outer housing 56 having a tubular hose mating section 58 integrally formed at one end of the housing 56 for securely engaging one end of the flexible hose 40. A generally tubular, metal, wand mating section 60 is fixedly secured to the other end of the housing 56 of the wand handle 42 for securely engaging the rigid wand 16. The wand mating section 16 includes a conventional, spring biased, depressible locking button 62 for receipt within a complementarily shaped aperture (not illustrated) formed through the wand 16 for releasably, fixedly securing the wand 16 in engagement with the wand handle 42.

In addition, a conventional, rotatable plastic suction adjust ring 64 is movably disposed about the outer periphery of the tubular metal wand mating section 60 for adjusting the amount of suction available at the floor cleaning unit 12. The suction adjust ring 64 is movable about the outer periphery of the section 60 to expose none, all or a portion of an inlet aperture 66 formed through the tubular metal wand mating section 60 for controllably adjusting the amount of suction available in the floor cleaning unit 12.

The wand handle 42 also includes a pair of female electrical connectors or contacts 68 disposed near the wand mating section 60 for electrically engaging a pair of mating electrical contacts (not illustrated) formed at one end of the power cord 50 secured to the wand 16. Disposed adjacent the tubular hose mating section 58 are a plurality of three male, electrical connectors or contacts 70 for electrically engaging mating electrical contacts (not illustrated) on the ends of the three electrical conductors 44, 46 and 48 disposed within the hose 40.

Finally, the wand handle 42 includes a three-position control switch 72 (FIGS. 2 and 3) and a plurality of electrical conductors 74 for electrically interconnecting the control switch 72 with the contacts 68 and 70. The three-position control switch 72 enables the deenergization of both the brush motor 28 and the vacuum motor 34 in a first or "OFF" position (FIG. 3), enables the energization of the vacuum motor 34 and the deenergization of the brush motor 28 in a second or "BARE FLOOR" position and enables the energization of both the brush motor 28 and the vacuum motor 34 in a third or "CARPET" position.

The electrical control system 11 (FIG. 4) includes the brush motor 28, the vacuum motor 34 and the three-position control switch 72, all interconnected during the manufacture of the vacuum cleaner 10 by an electrical control circuit schematically depicted in FIG. 4 that facilitates the manufacture of vacuum cleaners as discussed above and that enables the wand handle and hose assembly 18 to be used interchangeably with different models of canister vacuum cleaners. This interchangeability aspect of the present invention facilitates the display of various models of vacuum cleaners on a showroom floor and reduces the possibility of damage resulting from the inadvertent or intentional use of a wand handle and hose assembly 18 associated with one vacuum cleaner model in connection with the operation of a different vacuum cleaner model.

The electrical control system 11 also includes a conventional high-low speed switch 76 physically located on the canister 14 for controlling the speed of the vacuum motor 34. In addition, the control system 11 includes a conventional, normally open, vacuum switch 78 and an indicator light 80 for providing a visual indication to the operator of the vacuum cleaner 10 when the bag of the vacuum cleaner 10 located in the canister 14 is filled. When the differential pressure between the inlet and the exhaust of the vacuum cleaner 10 increases to a predetermined value indicative of the bag in the canister 14 being filled, the normally opened vacuum switch 78 closes to light the indicator light 80. The control system 11 also includes a conventional relay switch 82 disposed in the canister 14 and having a relay coil 84 that is energized when the three-position control switch 72 is in one or the other of its two "ON" positions, causing the closure of the relay contacts 86 and the energization of the vacuum motor 34. The use of the relay 82 prevents the relatively high current required by the vacuum motor 34 from passing through either the wand handle and hose assembly 18 or the control switch 72. Finally, a pair of power conductors 88 and 90 that form the retractable power cord 22 are schematically depicted in FIG. 4 in association with a retractable power cord reel 92.

The three-position control switch 72 as depicted in the schematic of FIG. 4 is illustrated in its first or "OFF" position in which both the brush motor 28 and the vacuum motor 34 are deenergized. In that position, a pair of switch poles 94 and 96 are both out of contact with their respectively associated switch contacts 95 and 97. When the control switch 72 is moved to its second or "BARE FLOOR" position, the switch pole 94 is moved into engagement with its associated switch contact 95 and the switch pole 96 is maintained out of engagement with its associated switch contact 97. In this manner, the relay coil 84 is energized to close the relay contacts 86 and thereby energize or turn on the vacuum motor 34. Finally, when the control switch 72 is placed in its third or "CARPET" position, the switch pole 94 is maintained in engagement with its associated relay contact 95 and the switch pole 96 is placed into engagement with its associated switch contact 97. In this manner, the brush motor 28 and the vacuum motor 34 are both energized.

Figure 5:
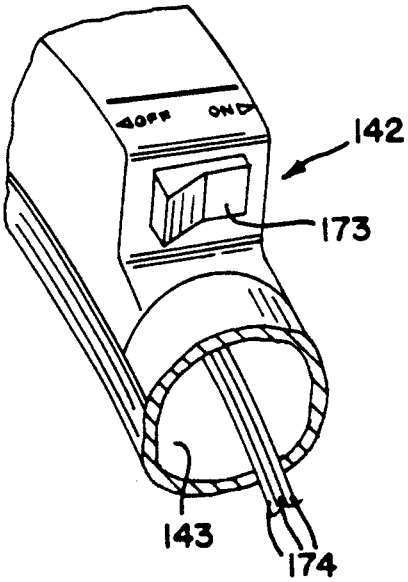
FIG. 5 is a fragmentary, perspective view, similar to the view of FIG. 3, in which a two-position control switch is mounted on the wand handle.
Figure 6:
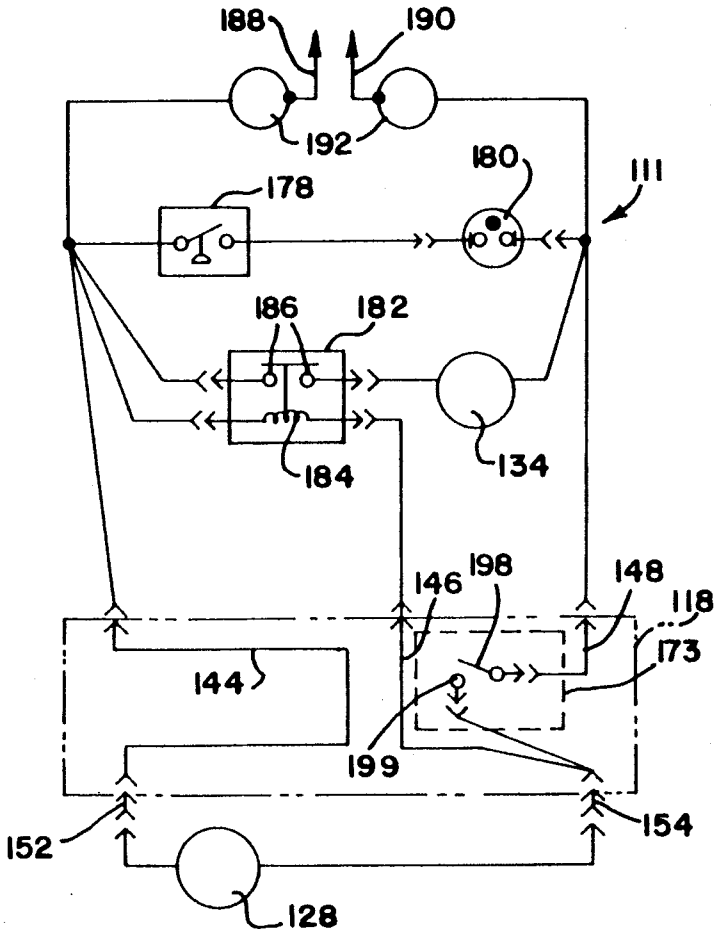
FIG. 6 is a schematic of an electrical control system for use in a canister vacuum cleaner having the two-position control switch of FIG. 5.

By configuring the electrical control circuit of the electrical control system 11 of the vacuum cleaner 10 in the manner schematically depicted in FIG. 4 and by interconnecting the various components of the vacuum cleaner 10 during its manufacture in accordance with that electrical control circuit, the wand handle and hose assembly 18 may be used interchangeably with a relatively less expensive model of a vacuum cleaner having an electrical control system 111 schematically illustrated in FIG. 6 and an associated wand handle 142 (FIG. 5) with a two-position control switch 173 (FIGS. 5 and 6). Components schematically depicted in FIG. 6 that correspond to similar components in FIG. 4 are designated by reference characters in which the units and tens digits are the same as the units and tens digits of the corresponding components in FIG. 4.

In a first or "OFF" position of the two-position control switch 173 as schematically depicted in FIG. 6, a switch pole 198 is maintained out of engagement with an associated switch contact 199 to maintain both the brush motor 128 and the vacuum motor 134 deenergized. In a second or "ON" position of the two-position control switch 173, the switch pole 198 is moved into engagement with the switch contact 199 to energize both the brush motor 128 and the vacuum motor 134.

As is clear from FIGS. 4 and 6, due to the particular configuration of the electrical circuit of the electrical control system 11 (FIG. 4), the wand handle and the hose assembly 18 can be intentionally or inadvertently used with a different model of a canister vacuum cleaner schematically illustrated in FIG. 6 in place of the wand handle and the hose assembly 118 (FIG. 6) without damaging any of the components of the less expensive vacuum cleaner model schematically illustrated in FIG. 6. In the event of such a substitution, however, the less expensive vacuum cleaner model will operate under the control of the three-position control switch 72 located in the wand handle and hose assembly 18, thereby enabling the selective energization of either the vacuum motor 134 alone or the brush motor 128 and vacuum motor 134 together. As is apparent from FIGS. 4 and 6, while not being effective to demonstrate all of the capabilities of the canister vacuum cleaner 10, the wand handle and the hose assembly 118 could be used in place of the wand handle and hose assembly 18 in the electrical control system 11 (FIG. 4) of the canister vacuum cleaner 10. The ability to substitute the wand handle and hose assembly 18 for the wand handle and hose assembly 118 and to use the assemblies 18 and 118 interchangeably on a showroom floor enables salesmen to demonstrate the respective capabilities of different models of vacuum cleaners without having to be concerned with the possibility of damaging a particular vacuum cleaner model as a result of the use of a wand handle and the hose assembly associated with a different vacuum cleaner model.

The importance of the particular configuration of the electrical control circuit of the electrical control system 11 (FIG. 4) may be appreciated by considering a different embodiment of an electrical control system 211 (FIG. 7) for electrically interconnecting and controlling the operation of the brush motor 28 and vacuum motor 34. As is apparent from FIGS. 4, 6 and 7, the relay 82 for energizing the motor 34 is disposed in the electrical control system 211 on an opposite side of the vacuum motor 34 from its position in the electrical control systems 11 (FIG. 4) and 111 (FIG. 6). In addition, the electrical control system 211 (FIG. 7) includes a wand handle and hose assembly 218 having a three-position control switch 273 mounted thereon In a first or "OFF" position of the control switch 273, a pair of switch poles 294 and 296 are maintained out of engagement with their respectively associated switch contacts 295 and 297. In a second or "BARE FLOOR" position of the control switch 273, the switch pole 294 engages its associated switch contact 295 and the switch pole 296 is maintained out of engagement with its associated switch contact 297, thereby energizing or turning on the vacuum motor 34 while maintaining the brush motor 28 deenergized. In a third or "CARPET" position of the control switch 273, the switch pole 294 is maintained in engagement with its associated switch contact 295 and the switch pole 296 is moved into engagement with its associated switch contact 297, thereby energizing or turning on both the brush motor 28 and the vacuum motor 34.

Even though the electrical control system 211 is effective for operating its particular model of a canister vacuum cleaner, due to the configuration of the electrical control circuit of the electrical control system 211, the wand handle and hose assembly 218 is not interchangeable with the wand handle and hose assembly 118 (FIG. 6) associated with a different model of a canister vacuum cleaner. For example, substituting the wand handle and hose assembly 218 into the electrical control system 111 (FIG. 6) in place of the wand handle and hose assembly 118 would not result in the operation of the brush motor 128 and the vacuum motor 134 as intended. That is, upon such an attempted substitution, the three-position control switch 273 in its first or "OFF" position would be effective to maintain the brush motor 128 and the vacuum motor 134 deenergized. However, in its second or "BARE FLOOR" position, the control switch 273 would be ineffective in that it would not energize the vacuum motor 134 because both ends of the relay coil 184 of the motor relay 182 would be at the same electrical potential when the switch pole 294 is placed in engagement with the switch contact 295. Furthermore, in the third or "CARPET" position of the control switch 273, only the brush motor 128 would be energized upon the engagement of the switch poles 294 and 296 with their respectively associated switch contacts 295 and 297.

Figure 7:
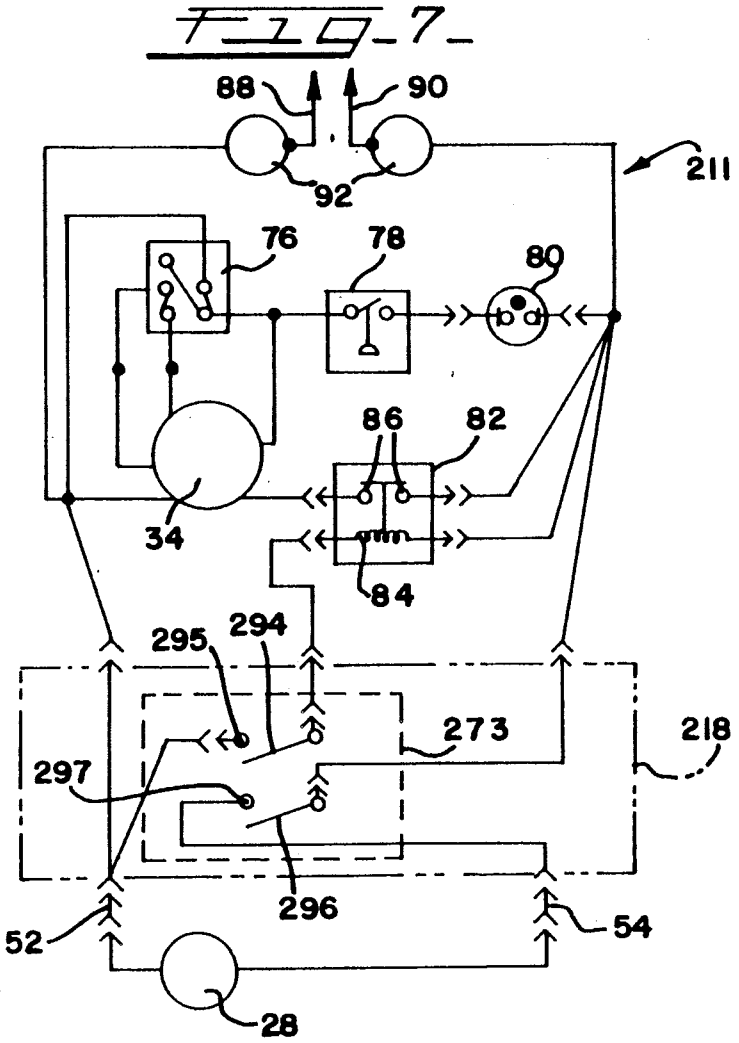
FIG. 7 is a schematic of an electrical control system for use in a canister vacuum cleaner having a three-position control switch of the type depicted in FIG. 3 in which interchangeability of the wand handle and hose assembly with other models of vacuum cleaners is not required.

As is apparent from FIGS. 4, 6 and 7, the particular configuration of the electrical control circuit of electrical control system 11 facilitates the manufacture of canister vacuum cleaners 10 because no more than four electrical conductors are required to be interconnected at any particular location or terminal within the canister vacuum cleaner 10. With the configurations schematically illustrated in FIGS. 6 and 7, five wires are required to be interconnected at one location in each of the electrical control systems 111 and 211.

Obviously, many modifications and variations of the present invention are possible in light of the above teachings. Thus, it is to be understood that, within the scope of the appended claims, the invention may be practiced otherwise than as specifically described hereinabove.

What is claimed and desired to be secured by Letters Patent is:

1. A method of manufacturing a canister vacuum cleaner comprising the steps of forming a floor cleaning unit having a rotatable brush and a brush motor for rotating said brush, forming a canister having a suction motor for providing suction, providing means for pneumatically interconnecting said canister and said floor cleaning unit to provide said suction at said floor cleaning unit, said pneumatically interconnecting means comprising a wand and a wand handle and hose assembly, said wand handle and hose assembly comprising a wand handle and a flexible hose, said wand being adapted physically to engage said floor cleaning unit, said flexible hose being adapted physically to engage said canister, said wand handle being adapted physically to engage both said wand and said flexible hose, disposing a three-position electrical control switch on said wand handle, said control switch in a first position being adapted to enable the deenergization of both said brush motor and said suction motor and in a second position being adapted to enable the energization of said suction motor and the deenergization of said brush motor and in a third position being adapted to enable the energization of both said brush motor and said suction motor, and configuring the electrical control circuit for said canister vacuum cleaner to enable the desired operation of said canister vacuum cleaner under the control of said three-position electrical control switch and to enable said wand handle and hose assembly including said three-position control switch to be used in a second canister vacuum cleaner in place of a second wand handle and hose assembly that forms a component part of said second vacuum cleaner, said second canister vacuum cleaner further including a second floor cleaning unit having a second rotatable brush and a second brush motor for rotating said brush and a second canister having a second suction motor for providing suction, said second wand handle and hose assembly including a second wand handle and a second flexible hose and a two-position electrical control switch disposed on said second wand handle, said two-position control switch in a first position being adapted to enable the deenergization of both said second brush motor and said second suction motor and in a second position being adapted to enable the energization of both said second brush motor and said second suction motor.

2. A method of manufacturing a canister vacuum cleaner as recited in claim 1 further comprising the step of disposing electrical relay means in said first mentioned canister for preventing the electrical current required to operate said first mentioned suction motor from passing through either said first mentioned wand handle and hose assembly or said three-position control switch.

3. A method of manufacturing a canister vacuum cleaner as recited in claim 1 further comprising the step of disposing three elongated electrical conductors internally within said first mentioned flexible hose for use in electrically interconnecting said first mentioned suction motor and said three-position control switch.

4. A method of manufacturing a canister vacuum cleaner as recited in claim 3 wherein said wand comprises a rigid wand for mechanically and pneumatically interconnecting said first mentioned floor unit with said first mentioned wand handle and hose assembly.

5. A method of manufacturing a canister vacuum cleaner as recited in claim 4 further comprising the step of disposing a pair of elongated electrical conductors along the length of said wand for use in electrically interconnecting said first mentioned brush motor and said three-position control switch.

6. A method of manufacturing a canister vacuum cleaner as recited in claim 5 further comprising the step of disposing means on said first mentioned canister for connecting said first mentioned canister vacuum cleaner to a source of alternating current electrical power.

* * * * *